United States Patent [19]

Salice

[11] Patent Number: 5,036,565

[45] Date of Patent: Aug. 6, 1991

[54] HINGE, PREFERABLY FOR HINGING A DOOR OR FLAP TO A CARRYING WALL OF A FURNITURE CORPUS

[75] Inventor: Luciano Salice, Carimate, Italy

[73] Assignee: Arturo Salice S.p.A., Novedrate, Italy

[21] Appl. No.: 524,007

[22] Filed: May 16, 1990

[30] Foreign Application Priority Data

May 19, 1989 [DE] Fed. Rep. of Germany ..... 3916349
Mar. 21, 1990 [DE] Fed. Rep. of Germany ..... 4009125

[51] Int. Cl.[5] ..... E05D 7/04

[52] U.S. Cl. ..... 16/358; 16/360; 16/DIG. 43

[58] Field of Search ..... 16/240, 246, 343, 346, 16/357, 364, 370, 371, 382, DIG. 43, 358, 360, 236

[56] References Cited

U.S. PATENT DOCUMENTS

| | | | |
|---|---|---|---|
| 3,470,579 | 10/1969 | Cencioni . | |
| 3,673,635 | 7/1972 | Cencioni | 16/368 |
| 3,978,549 | 9/1976 | Vitt | 15/370 |
| 4,091,501 | 5/1978 | Lautenschlager et al. | 16/357 |
| 4,470,170 | 9/1984 | Gerteis | 16/370 |
| 4,701,979 | 10/1987 | Salice | 16/346 |
| 4,736,491 | 4/1988 | Mertes | 16/368 |

FOREIGN PATENT DOCUMENTS

| | | | |
|---|---|---|---|
| 637723 | 11/1936 | Fed. Rep. of Germany . | |
| 1559815 | 1/1970 | Fed. Rep. of Germany | 16/357 |
| 2303985 | 8/1974 | Fed. Rep. of Germany | 16/364 |
| 2415999 | 10/1975 | Fed. Rep. of Germany . | |
| 2511201 | 9/1976 | Fed. Rep. of Germany | 16/371 |
| 2524532 | 12/1976 | Fed. Rep. of Germany | 16/360 |
| 2823090 | 11/1979 | Fed. Rep. of Germany | 16/357 |
| 2852229 | 6/1980 | Fed. Rep. of Germany . | |
| 3100526 | 12/1981 | Fed. Rep. of Germany . | |
| 3442421 | 1/1986 | Fed. Rep. of Germany . | |
| 478975 | 11/1969 | Switzerland . | |
| 986147 | 3/1965 | United Kingdom . | |
| 2049800 | 12/1980 | United Kingdom | 16/360 |

*Primary Examiner*—Richard K. Seidel
*Assistant Examiner*—Edward A. Brown
*Attorney, Agent, or Firm*—Fleit, Jacobson, Cohn, Price, Holman & Stern

[57] ABSTRACT

A hinge, preferably for hinging a door or flap to a carrying wall of a furniture corpus, comprises a cup-shaped hinged hinge member and a hinge bracket, which is articulatedly connected to the hinge member by two links and is adapted to be mounted on the carrying wall by a carrying plate. One of the links is extended in length beyond the pivot pin by which the link is connected to the hinge bracket, and that extended length portion of the link is so connected by a coupling link or by a guide slot to a pin which is mounted on the carrying plate or on an intermediate plate, which is adapted to be connected to the carrying plate, that the hinge bracket will be pivotally and longitudinally displaceably held on the carrying plate or on the intermediate plate by pin-slot guides during pivotal movement of the one link.

9 Claims, 5 Drawing Sheets

HINGE, PREFERABLY FOR HINGING A DOOR OR FLAP TO A CARRYING WALL OF A FURNITURE CORPUS

BACKGROUND OF THE INVENTION

1. Field of the Invention

This invention relates to a hinge, preferably for hinging a door or flap to a carrying wall of a furniture corpus, comprising a cup-shaped hinged hinge member and a hinge bracket, which is articulatedly connected to the hinge member by two links and is adapted to be mounted on the carrying wall by a carrying plate.

2. Description of the Prior Art

During an opening movement of a door which is mounted by such a hinge, the door performs a pivotal movement, during which the outer edge of the narrow end face on the hinge side of the door is moved beyond the space which is occupied by the end portion of the door when it is closed. This movement can usually be tolerated because under normal conditions, the narrow end face on the hinge side of the door is adjoined by a free space or because a sufficiently large gap is provided between the end face and the adjacent end face of an adjacent door or other adjacent structural part. As a result, under such conditions, the outer edge formed between the narrow end face and the front broadside of the door will not strike against an obstacle as the door is opened. However, problems may arise if, for instance, a thick door is separated only by a narrow gap from an adjacent door or an adjacent structural part, or if ornamental bars or other ornamental elements have been mounted on the outside broadside of the door so that the door has a larger thickness or is provided with projections in that region.

SUMMARY OF THE INVENTION

For this reason, it is an object of the invention to provide a hinge which is of the kind described first hereinbefore and which permits an opening of the door to a large extent without an obstruction, even if the door is thick, or if there is a large distance between the bore for the receiving of the hinged hinge member and the narrow end face on the hinge side of the door and if there is only a narrow gap between the door and an adjacent door or an adjacent structural part, or if the door is additionally provided with ornamental bars or the like.

In a hinge which is of the kind described first hereinbefore, that object is accomplished in accordance with the invention in that one of the links is extended in length beyond the pivot pin by which the link is connected to the hinge bracket and in that the extended length portion of the link is so connected by a coupling link or by a guide slot to a pin which is mounted on the carrying plate or on an intermediate plate, which is adapted to be connected to the carrying plate, so that the hinge bracket will be pivotally and longitudinally displaceably held on the carrying plate or on the intermediate plate by pin-slot guides during a pivotal movement of the one link.

During a pivotal movement of the hinged hinge member of the hinge, in accordance with the invention, to the open position, the hinge bracket of the hinge will perform an inward pivotal movement and will be displaced outwardly at the same time. As a result, the opening movement of the door will be accompanied by a substantial widening of the gap which exists between the hinge-side end face of the door and an adjacent structural part and the gap existing between the inner broadside of the door and the end face of the carrying wall which carries the door. This means that the hinge bracket will perform a pivotal movement in a sense which is opposite to the pivotal movement of the door and the hinge bracket will be displaced outwardly at the same time. As a result, during an opening movement of the door from its closed position, the edge portion of the door on the hinge side thereof will be displaced inwardly and, in addition, outwardly, so that there will be a sufficiently large free space even if the door has a considerable thickness or is provided with ornamental bars or the like.

Because, in the hinge in accordance with the invention, an opening movement of the door will impart to the hinge bracket a translational movement toward the outside and a superimposed pivotal movement in a sense which is opposite to the pivotal movement of the door, it will be sufficient to design the hinged hinge member, by which the door is mounted, to have only a small thickness so that the hinge, in accordance with the invention, may also be designed as a hinge for glass doors.

Owing to the movable mounting of the hinge bracket, the hinge in accordance with the invention permits the door to be opened through a large angle. Whereas that angle is smaller than the angle of the opening movement which is permitted by so-called wide-angle hinges, the hinge in accordance with the invention is more compact and robust and occupies a smaller space and can be made at lower cost than such wide-angle hinges.

In accordance with a preferred feature, the rear and forward portions of the flanges of the hinge bracket and of the side portions of the carrying plate or intermediate plate are interconnected by pin-slot guides, and at least the forward slots of such guides are upwardly and outwardly inclined from the horizontal at an acute angle.

In order to insure that the door, in its fully opened position, will be disposed entirely outside the inside width of the furniture, a preferred feature resides in that the slot of the pin-slot guide is downwardly inclined from the horizontal toward the carrying plate in the direction toward the hinged hinge member. This design ensures that the door, which has been opened through 90 degrees, will be flush with the inside surface of the corpus part which carries that door or will even be outwardly offset from such corpus part.

It will be understood that the slot of the pin-slot guide may have an inclination or curvature which will ensure a desired characteristic of the pivotal movement of the hinge bracket.

Even if the slot of the pin-slot guide is not designed to ensure that the fully opened door will be disposed outside the inside width of the piece of furniture, that slot may be so designed that the pivotal movement can be performed through the entire angle which is permitted by the articulating system or that said angle will even be increased because a pivotal movement of the door to its fully open position will not impart to the hinge bracket a pivotal movement in a sense which is opposite to the pivotal movement of the door as it approaches its fully open position.

A coupling member is desirably pivoted to a rising rear portion of the carrying plate or of the intermediate plate so that the coupling member can easily impart the desired movement to the rear and portion of the hinge bracket.

The coupling member suitably consists of a U-shaped member having a web and legs which, adjacent to the web, are pivoted to the carrying plate or intermediate plate.

In accordance with a preferred feature, the inner link is extended in length beyond the pivot pin connecting the link to the hinge bracket, and the extension is articulatedly connected, adjacent to its free end, to the carrying plate or intermediate plate by the coupling link. That design affords the additional advantage that the door can be opened through a particularly large angle, which is not normally permitted by other hinges of the kind described first hereinbefore.

In accordance with a further feature, the inner link is extended in length beyond the pivot pin by which said inner link is connected to the hinge bracket, the extension is provided with a guide slot for receiving the bolt or pins of the carrying plate or intermediate plate, and the bolt is or the pins are additionally guided in the forward slots of the flanges of the hinge bracket. The guide slot in the extension of the link may be formed in the flanges of the channel-shaped link or may be constituted by a hairpinlike loop formed in the extension.

In the embodiments described hereinbefore the rear mounting permitting of a displacement and a pivotal movement comprises a pin-slot guide in which the slot is approximately parallel to the carrying plate. On the other hand, the slot of the forward pin-slot guide is outwardly and upwardly inclined from the horizontal so that it progressively departs from the carrying plate. As a result, a pivotal movement of the pivoted hinge member to its open position will impart to the hinge bracket an inwardly directed pivotal movement and a simultaneous outward displacement so that the opening movement of the door will result in a considerable widening of the gap existing between the hinge side and face of the door and an adjacent structural part and of the gap existing between the inner broadside of the door and the end face of the carrying wall which carries the door. The hinge bracket will then perform a pivotal movement in a sense which is opposite to the pivotal movement of the door and will simultaneously perform an outward displacement so that during an opening movement of the door from its closed position the edge portion on the hinge side of the door will be displaced inwardly and outwardly at the same time and a sufficiently large free space will thus be provided, even if the door has a considerable thickness or is provided with ornamental bars or the like. However, this pivotal movement of the hinge bracket, in a sense which is opposite to the pivotal movement of the door, will have the result that the inward pivotal movement of the door will reduce the inside width of the piece of furniture so that an extraction of possibly provided slidable members, such as drawers or the like, will be prevented.

For this reason a particularly preferred embodiment may be adopted, in which the rear mounting means comprise a coupling member which, adjacent to the rear end of the hinge bracket, is articulately connected to the hinge bracket and to the carrying plate or intermediate plate, and the coupling member has such a length that during a pivotal movement of the hinged hinge member to the open position, at least the rear portion of the hinge bracket will perform a movement by which the rear portion is lifted from the carrying plate or intermediate plate and the movement is superimposed on the outwardly directed translational movement of the hinge bracket. Owing to the kinematics of the means by which the hinge bracket is connected to the carrying plate or intermediate plate in the hinge in accordance with the invention, a pivotal movement in the sense of the pivotal opening movement of the door will be imparted to the hinge bracket at least during the final phase of the opening movement of the door.

DETAILED DESCRIPTION OF THE PREFERRED EMBODIMENTS

Figure 1:
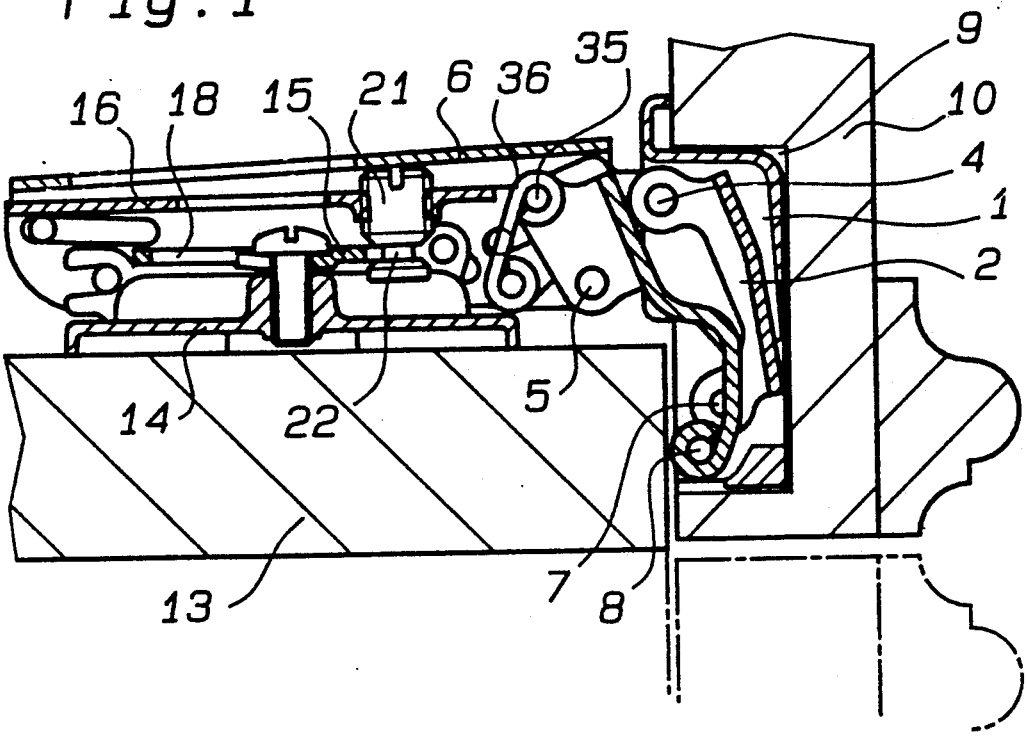
FIG. 1 is a longitudinal sectional view showing a first embodiment of the hinge in a closed position.

Illustrative embodiments of the invention will now be described in more detail with reference to the drawings.

The hinge illustrated in FIGS. 1 to 12 comprises a hinged cup-shaped hinge member 1, which, by links 2, 3 and pivot pins 4, 5, is articulately connected in the usual manner to the channel-shaped hinge bracket 6. The outer ends of the links 2, 3 are pivoted on pivot pins 7, 8 in the cup-shaped hinge member 1. The hinged cup-shaped hinge member 1 is received in a milled bore 9 formed in the door 10 and is secured to the door 10 in the usual manner. The cup-shaped hinge member 1 constitutes the hinged part by which the door is fixed and may have any other suitable design. The inner link 3 is provided with an extension 11, which extends in length beyond the bore 12 and beyond the pivot pin 5.

Figure 2:
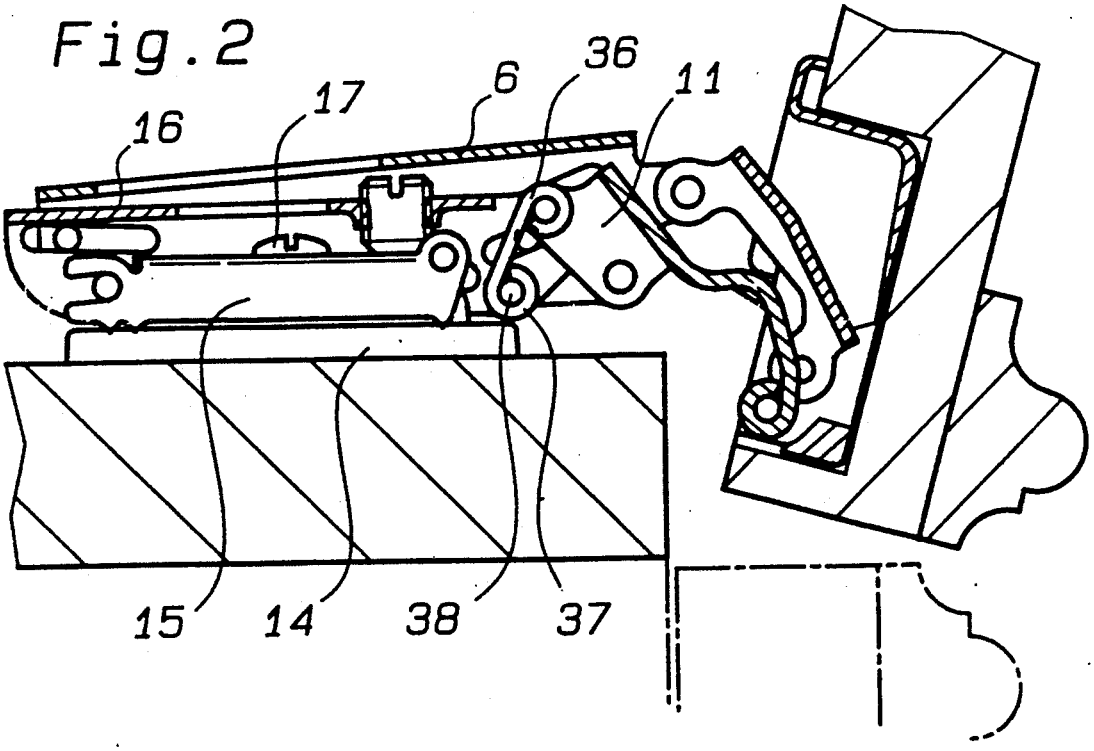
FIG. 2 is a view which is similar to FIG. 1 and shows the hinge when the door has partly been opened.
Figure 3:
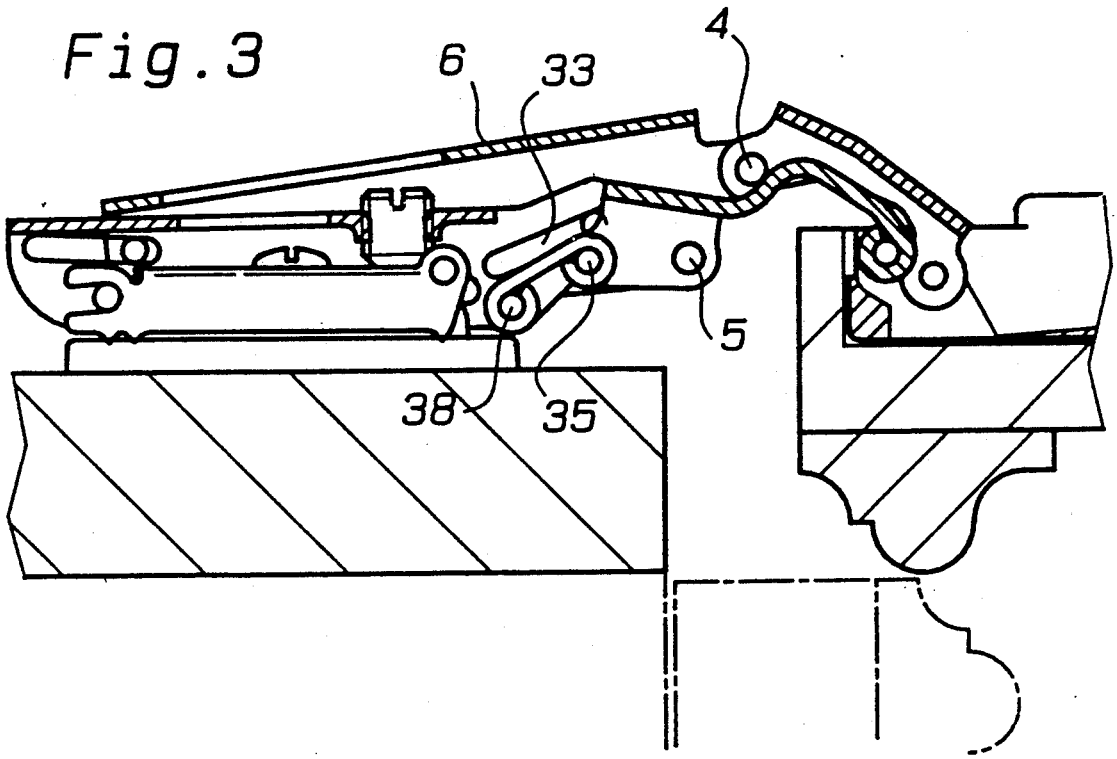
FIG. 3 is a view which is similar to FIG. 1 and shows the hinge after the door has been opened through 90 degrees.
Figure 4:
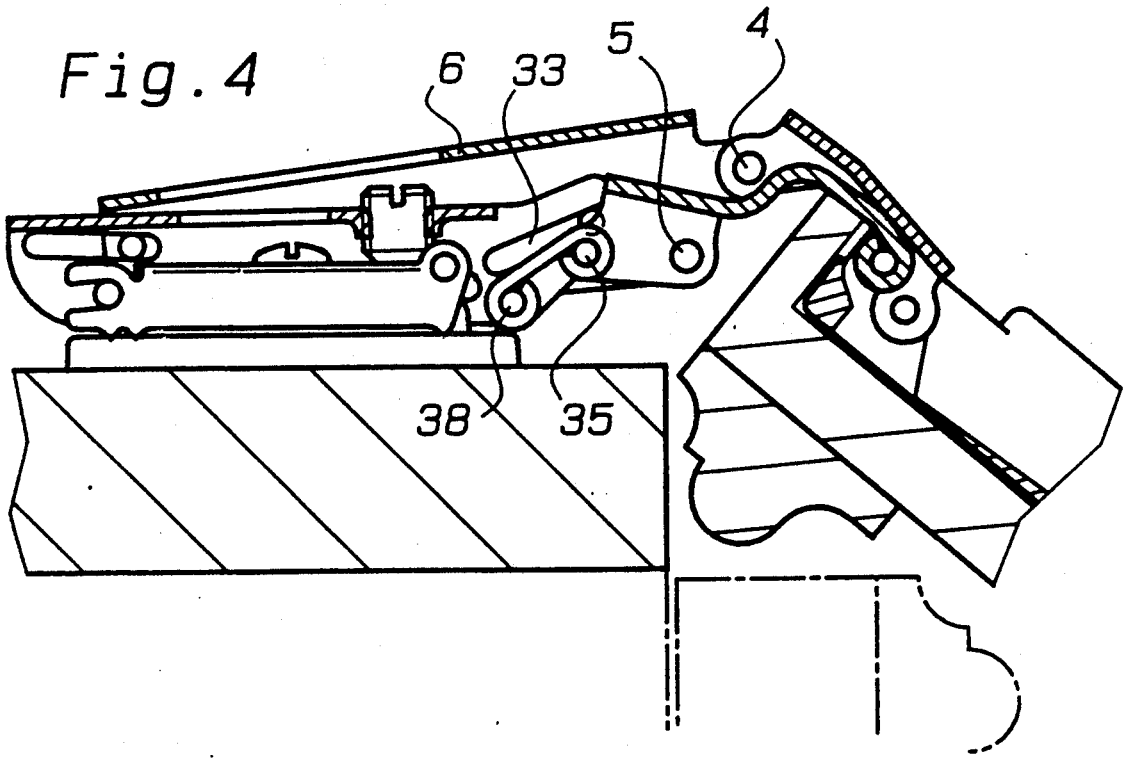
FIG. 4 is a view which is similar to FIG. 1 and shows the hinge when the door has been moved through the largest possible angle to its fully opened position.

A carrying plate 14 is connected by screws to the carrying wall 13 and, as is apparent from FIGS. 1 and 2, is connected to a first intermediate plate 15 and a second intermediate plate 16. The first intermediate plate 15 is channel-shaped and is connected to the carrying plate 14 by the fixing screw 17, which extends into a keyhole-shaped slot 18 in the web of the first intermediate plate 15. The slot 18 permits an adjustment of the hinge bracket 6 in its longitudinal direction.

The second intermediate plate 16 is mounted on the first intermediate plate 15 and is also channel-shaped. The adjusting screw 21 is screwed into the tapped flanged bore 20 of the web of the second intermediate plate 16 and is formed with an annular groove 22, which receives the web of the first intermediate plate 15 in a slot 22', which is open at its forward end. On the inside of the second intermediate plate, the rear portions of the flanges of the plate 16 are provided with projecting pins 23, which are guided in the first intermediate plate 15 in slots having open rear ends. The forward portions of the flanges of the intermediate plate 15 are provided with a bolt or with projecting pins 24', which extend into oblique slots 25 in the flanges of the second intermediate plate 16.

Upon an adjustment effected by the adjusting screw 21, the second intermediate plate 15 will perform a pivotal movement and a superimposed translational movement so that a lateral adjustment of the door will not change the width of the gap between the door and the corpus part. That design is disclosed in German Patent Specification 34 42 421 and in corresponding U.S. Pat. No 4,701,979, the disclosure of which is incorporated herein by reference.

The channel-shaped hinge bracket 6 has two flanges, which are connected by a web and in their rear and forward portions are provided on the inside with projecting pins 30 and 31, which extend into slots 32, 33 of the upper intermediate plate 16, which is embraced at least in part by the hinge bracket 6. The slots 32 are formed in the rear portions of the flanges of the intermediate plate 16. The slots 33 are formed in the forward portions of said flanges and have open forward ends. The slots 33 are upwardly inclined at an acute angle to the horizontal.

A bolt 35 is held in the bores 12 of the flanges of the extension 11 of the inner link 3. The coupling link 36 has a curled-in eyelike upper end portion 37, which is pivoted on the pin 35. The curled-in eyelike lower end portion 37 of the inner link 3 is pivoted on a bolt 38, which is held in bores 39 in the side flanges of the upper intermediate plate 16. The bolt 38 is disposed below the inner end of the slot 33.

During an opening movement of the door 10 and of the cup-shaped hinge member 1 the hinge bracket 6 will perform a rotation about an imaginary pivotal axis, the location of which is defined by the intersection of the normals on the axes of the guide pins 30, 31 extending through the slots 32, 33. The arrangement and course of the slots 32, 33, and the arrangement of the links on which the link 36 is movably mounted and the length of the link 36, may be selected to determine the pivotal movement performed by the hinge bracket 6 during an opening movement of the door.

Figure 5:
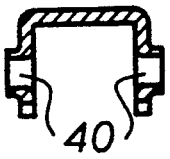
FIG. 5 is a transverse sectional view taken on line V—V in FIG. 6 and showing the inner link.
Figure 6:
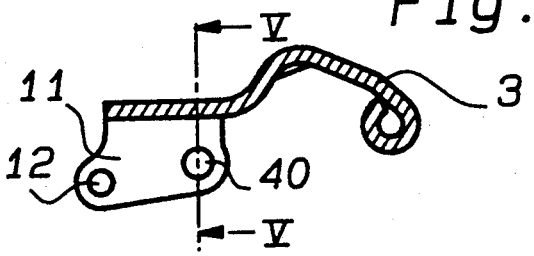
FIG. 6 is a longitudinal sectional view showing the inner link.
Figure 8:
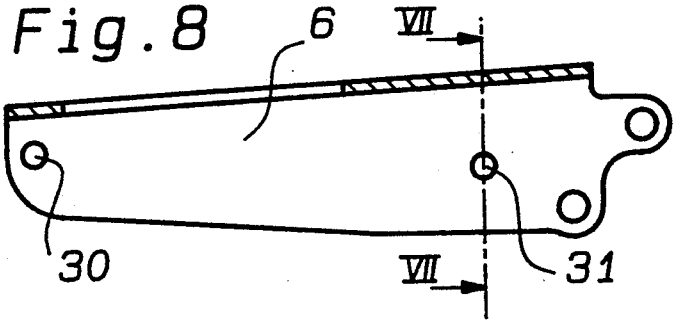
FIG. 8 is a longitudinal sectional view showing the hinge bracket.
Figure 7:
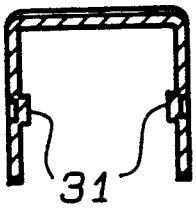
FIG. 7 is a transverse sectional view taken on line VII—VII in FIG. 8 and showing the hinge bracket.
Figure 10:
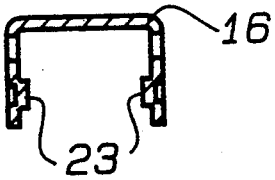
FIG. 10 is a transverse sectional view taken on line X—X in FIG. 9 and showing the upper intermediate plate.
Figure 9:
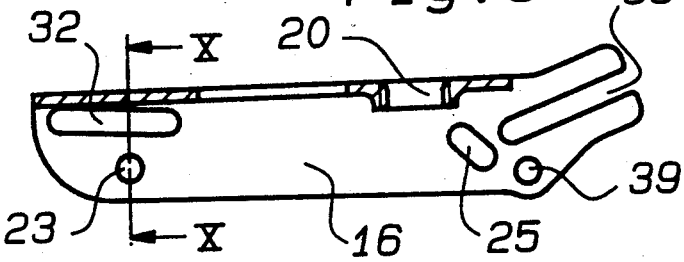
FIG. 9 is a longitudinal sectional view showing the upper intermediate plate.
Figure 11:
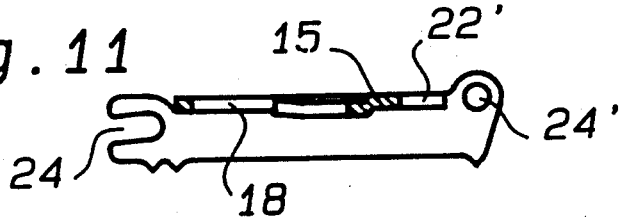
FIG. 11 is a longitudinal sectional view showing the lower intermediate plate.
Figure 12:
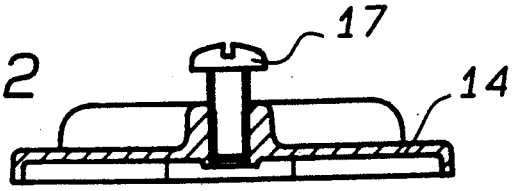
FIG. 12 is a longitudinal sectional view showing the carrying plate.

As is apparent from FIG. 5 the bores 40 of the inner link 3 have outwardly directed edge flanges, which may be formed by stamping and will permit an adaptation of the links to the width of the hinge bracket and to the other parts of the hinge. The flanges at the bores 40 will also improve the strength.

Figure 13:
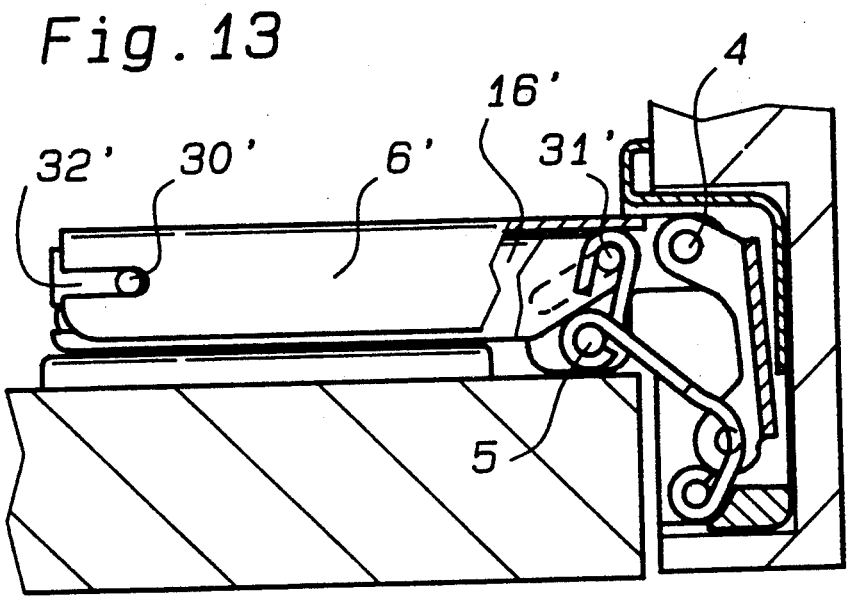
FIG. 13 is a side elevation showing, partly in section, a second embodiment of the hinge in its closed position.
Figure 14:
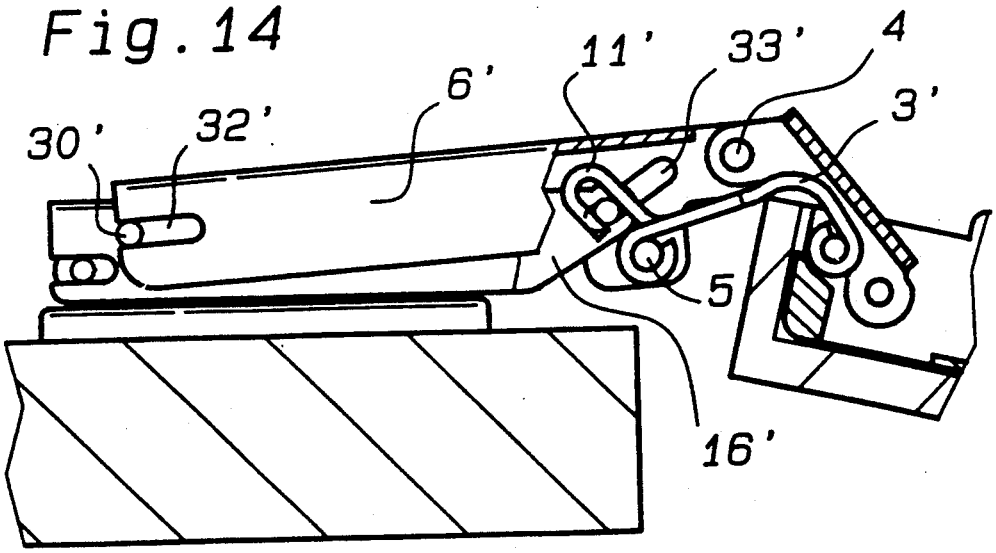
FIG. 14 is a view which is similar to FIG. 13 and shows the hinge when the door has been opened.
Figure 15:
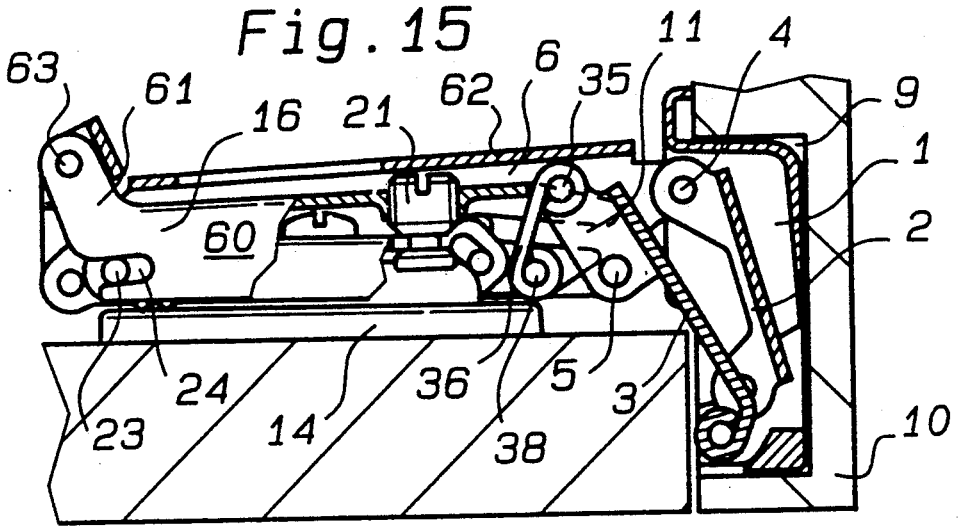
FIG. 15 is a side elevation showing a third embodiment of the hinge with the hinge bracket and the hinge member shown in section and in the position assumed by the hinge when the door is closed.
Figure 17:
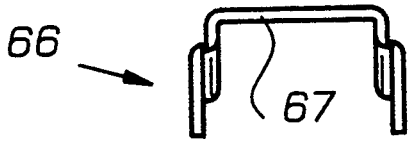
FIG. 17 is a front elevation showing the coupling member by which the hinge bracket shown in FIGS. 15 and 16 is articulatedly connected to the intermediate plate.
Figure 18:
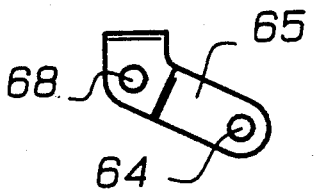
FIG. 18 is a side elevation showing the coupling member of FIG. 17.

In the embodiment shown in FIGS. 13 and 14 the rear guide pins 30' are provided on the outside of the flanges of the upper intermediate plate 16 and extend into open-ended slots 32' formed in the rear portions of the flanges of the hinge bracket 6'. The flanges of the hinge bracket 6' are provided in their forward portions with slots 33', which are upwardly inclined from the horizontal at an acute angle and which receive pinlike end portions, which protrude outwardly from the flanges of the intermediate plate 16' and are constituted by a bolt 31', which is held in suitable bores of the flanges of the upper intermediate plate 16. The inner link 3' is provided with an extension 11', which is curved like a hairpin to define between its legs a gap 42 for guiding the bolt 31'.

The hinge which is illustrated in FIGS. 15 to 18 comprises a hinged cup-shaped hinge member 1, which by links 2, 3 and pivot pins 4, 5, is articulately connected in the usual manner to the channel-shaped hinge bracket 6. The outer ends of the links 2, 3 are pivoted on pivot pins 7, 8 in the cup-shaped hinge member 1. The hinged cup-shaped hinge member 1 is received in a milled bore 9 formed in the door 10 and is secured to the door 10 in the usual manner. The cup-shaped hinge member 1 constitutes the hinged part by which the door is fixed and may have any other suitable design. The inner link 3 is provided with an extension 11, which extends in length beyond the bore 12 and beyond the pivot pin 5.

A carrying plate 14 is connected by screws to the carrying wall 13 and, as is apparent from FIGS. 1 and 2, is connected to a first intermediate plate and to a further intermediate plate 16. The first intermediate plate is also channel-shaped and is connected to the carrying plate 14 by a fixing screw, which extends through a slot in the web of the first intermediate plate. The second intermediate plate 16 is mounted on the first intermediate plate and is also channel-shaped. An adjusting screw 21 is screwed into a tapped flanged bore of the web of the first intermediate plate 16 and has an annular groove, which receives the web of the first intermediate plate in a slot, which has an open forward end. The flanges of the first intermediate plate are provided in their rear portions with projecting pins 23, which are guided in slots 24, which are formed in the second intermediate plate 16 and have open rear ends. The forward portions of the flanges of the intermediate plate 16 are provided with a bolt or with projecting pins, which extend into inclined slots in the flanges of the first intermediate plate. Upon an adjustment effected by the adjusting screw 21, the second intermediate plate 16 will perform a pivotal movement and a superimposed translational movement so that a lateral adjustment of the door will not change the width of the gap between the door and the corpus part. That design is disclosed in German Patent Specification 34 42 421 and in corresponding U.S. Pat. No. 4,701,979, the disclosure of which is incorporated herein by reference.

The channel-shaped hinge bracket 6 has two flanges, which are connected by a web and, in their rear and forward portions, are provided on the inside with projecting pins 30 and 31, which extend into slots 32, 33 of the upper intermediate plate 16, which is embraced at least in part by the hinge bracket 6. The slot 33 is so inclined that its open end is closer to the corpus part and the carrying plate 14.

A bolt 35 is held in the bores formed in the flanges of the extension 11 of the inner link 3 and the curled-in eyelike upper end portion of the coupling link 36 is pivoted on a the bolt 35. The curled-in eyelike lower end portion 37 of the link 36 is pivoted on a bolt 38, which is held below the slot 33 in bores formed in the side flanges of the upper intermediate plate 16.

The side flanges 60 of the hinge bracket are provided with rearwardly directed length extensions 61, which protrude beyond the web 62 of the hinge bracket 6. The forklike extensions 61 are formed with bores, each of which receives a short riveted pin 63. The pins 63 extend through bores 64 formed in the legs 65 of the U-shaped coupling member 66 so that the latter is pivoted to the extensions 61. Close to the web 67 of the coupling member 66, the legs 65 of the latter are formed with additional bearing bores 68.

Figure 16:
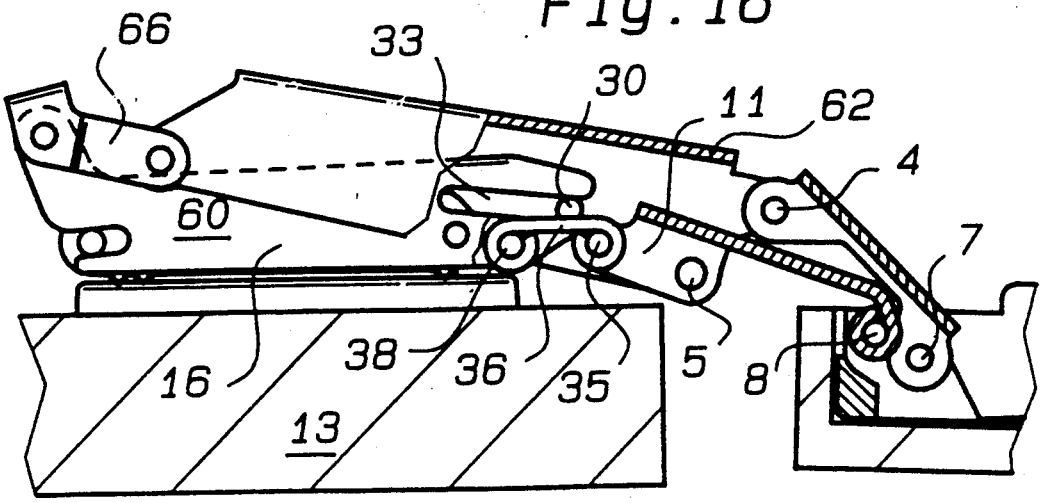
FIG. 16 is a side elevation which is similar to FIG. 15 but shows the hinge in an open position.

It is apparent from FIG. 16 that the hinge bracket 6 is connected to the intermediate plate 16 by motion-transmitting means, which ensure that the inner broadside of the door 10 will be flush with the inside surface of the corpus part 13 when the door has been opened through 90°.

I claim:

1. A hinge for hinging a door or flap to a carrying wall of a furniture corpus, comprising:

a cup-shaped hinge member;

a hinge bracket, articulatedly connected to the hinge member by two links;

a carrying plate for mounting said hinge bracket on the carrying wall, one of the two links having an extended length portion which is extended in length beyond a pivot pin by which said one of the two links is connected to the hinge bracket;

coupling means for coupling said extended length portion of said one of the two links to a pin which is mounted on one of the carrying plate and an intermediate plate, which is adapted to be connected to said carrying plate, so that the hinge bracket will be pivotally and longitudinally displaceably held on one of the carrying plate and the intermediate plate by pin-slot guides during a pivotal movement of said one of the two links.

2. A hinge according to claim 1, characterized in that the hinge bracket includes flanges and one of the carrying plate and the intermediate plate includes side portions, rear and forward portions of the flanges of the hinge bracket and of the side portions being interconnected by said pin-slot guides, at least forward slots of said pin-slot guides being upwardly and outwardly inclined from the horizontal at an acute angle.

3. A hinge according to claim 1, characterized in that the one of the two links having an extended length portion which is extended in length beyond the pivot pin is an inner link articulatedly connected, adjacent to a free end thereof, to one of the carrying plate and the intermediate plate by the coupling means.

4. A hinge according to claim 1, characterized in that lines which intersect pins or bolts connecting said one of the two links, said hinge bracket and said intermediate plate include an acute angle when the hinge is closed and an obtuse angle when the hinge is open.

5. A hinge according to claim 1, characterized in that the hinge bracket is pivotally movably and longitudinally displaceably held on the carrying plate or on the intermediate plate during a pivotal movement of the one of the two links, that adjacent to a rear end of the hinge bracket, the coupling means is articulatedly connected to the hinge bracket and to the carrying plate or to the intermediate plate, and that the coupling means has such a length that during a pivotal movement of the cup-shaped hinge member to an open position, at least a rear portion of the hinge bracket will perform a movement by which said rear portion is lifted from the carrying plate or intermediate plate and said movement is superimposed on outwardly directed translational movement of the hinge bracket.

6. A hinge according to claim 5, characterized in that a slot of one of the pin-slot guides is downwardly inclined from the horizontal toward the carrying plate in a direction toward the cup-shaped hinge member.

7. A hinge according to claim 5, characterized in that the coupling means is pivoted to a rising rear portion of the carrying plate or of the intermediate plate.

8. A hinge according to claim 5, characterized in that a slot of one of the pin-slot guides has an inclination or curvature which ensures a desired pivotal movement of the hinge bracket.

9. A hinge according to claim 5, characterized in that the coupling means consists of a U-shaped member having a web and legs, which adjacent to said web are pivoted to the carrying plate or to the intermediate plate.

* * * * *